United States Patent [19]

Jacob et al.

[11] Patent Number: 4,530,128

[45] Date of Patent: Jul. 23, 1985

[54] MOTOR DRIVEN CYLINDRICAL BRUSH FOR A CLEANING APPARATUS

[75] Inventors: Gernot Jacob, Weissach-Flacht; Robert Maier, Nufringen, both of Fed. Rep. of Germany

[73] Assignee: Progress-Electrogeräte Mauz & Pfeiffer GmbH & Co., Stuttgart, Fed. Rep. of Germany

[21] Appl. No.: 564,084

[22] Filed: Dec. 21, 1983

[30] Foreign Application Priority Data

Dec. 21, 1982 [DE] Fed. Rep. of Germany ..... 3247298

[51] Int. Cl.[3] ..... A46B 7/10

[52] U.S. Cl. ..... 15/182; 15/366

[58] Field of Search ..... 15/179, 181, 182, 183, 15/364, 365, 366, 370, 383, 386, 389, 390, 400

[56] References Cited

U.S. PATENT DOCUMENTS

| | | | |
|---|---|---|---|
| Re. 17,615 | 3/1930 | Hoover | 15/366 |
| 1,903,867 | 4/1933 | Lehmann | 15/366 X |
| 3,564,637 | 2/1971 | Gollish | 15/182 |
| 4,355,436 | 10/1982 | Hertzberg | 15/383 |

FOREIGN PATENT DOCUMENTS

| | | | |
|---|---|---|---|
| 145701 | 7/1981 | Fed. Rep. of Germany | 15/389 |
| 2086717 | 5/1982 | United Kingdom | 15/182 |

*Primary Examiner*—Peter Feldman

*Attorney, Agent, or Firm*—Becker & Becker, Inc.

[57] ABSTRACT

A motor driven cylindrical brush for a cleaning apparatus. The brush has bristles which lie in the zone outside a bearing section provided with a contact surface for a drive belt. Between the bristle filling and the bearing section, the brush member has recessed annular grooves. Via these grooves, it is possible to compensate for length changes of the brush member. These length changes occur when the brush filling is anchored in the brush member. By compensating for these length changes, the brush is very smooth running, and minimum bearing loading occurs.

6 Claims, 4 Drawing Figures

MOTOR DRIVEN CYLINDRICAL BRUSH FOR A CLEANING APPARATUS

BACKGROUND OF THE INVENTION

The present invention relates to a motor driven cylindrical brush for a cleaning apparatus having a cylindrical brush member with bristle filling projecting beyond it, and with a contact surface for a drive belt, and with a bearing spindle, the spindle ends of which project beyond the brush member and are disposed in a brush housing.

Brushes of this type are used, for example, in vacuum cleaner nozzles for cleaning floors, especially textile floor coverings. Via the drive belt, the rotary motion of a drive motor, preferably an electric motor, of the cleaning apparatus is transmitted to the brush member. The belt contact surface is convexly curved in the longitudinal direction of the brush member, so that the relevant brush member section forms a pulley, which ensures that the drive belt, during brush operation, maintains its central position relative to the brush member section. The tufts of bristles of the bristle filling projecting beyond the brush member extend linearly or helically to the axis of the brush member. When the brush is in use, the projecting ends of the tufts of bristles penetrate the surface of the floor coverings which are to be cleaned. Thus, the dirt is released from the floor covering, is picked up by the suction stream of the cleaning apparatus, and is carried to a filtering dust collection receptacle of the vacuum cleaner.

The tufts of bristles are inserted and anchored in holes which extend approximately radially to the brush member. Also known are bristle fillings in which the tufts of bristles are inserted in a separate strip-like holder. These holders are inserted into grooves which extend axially or helically on the brush member. In such brushes, however, the brush member consists of a large number of component parts, such as the brush member, the bearing spindle, and the holders for the tufts of bristles, so that these brushes are extremely complicated and expensive. Thus, for economic reasons, in apparatus or equipment for domestic use, brushes are used which are made in one piece from wood, plastic, or metal. When the brush member consists of thermoplastic material, and is produced by injection molding, the holes for receiving the tufts of bristles can be made simultaneously with the brush member. The tufts of bristles are anchored in the holes with wire retainers, which pass through one end of the tuft of bristles and have projecting ends thereof pushed under pressure against the side walls of the holes. Brushes of this type can be manufactured at low cost in automatic and semi-automatic production systems. Frequently, brushes of this type are unsteady in operation and are out of true, which can only be compensated for by subsequent dynamic balancing. These measures are complicated and time-consuming, and thus make the brush manufacture more expensive. Moreover, the lack of trueness cannot always be remedied fully, which can result in considerable bearing loading. The unsteady running is created by a change in length of the brush member in the course of being filled with bristles, which is caused by the fact that the brush member is extended somewhat during the fastening of the tufts of bristles in the relevant holes, as a consequence of material compression, thus resulting in buckling.

It is an object of the present invention to design a brush of the aforementioned general type in such a way that any buckling occurring when the bristle filling is attached in the brush member, and caused by length changes, and consequently any unsteady running, are fully avoided.

BRIEF DESCRIPTION OF THE DRAWING

This object, and other objects and advantages of the present invention, will appear more clearly from the following specification in conjunction with the accompanying drawing, in which.

SUMMARY OF THE INVENTION

The brush of the present invention is characterized primarily in that the brush member has at least one length compensating zone, which extends at right angles to its longitudinal axis.

In the length compensation zone of the brush member, the stresses or material compressions which occur during anchoring of the bristle filling in the brush member, and which produce a length change in the brush member, can be perfectly compensated for. As a result, the brush member does not buckle after attachment of the bristle filling, so that labor-intensive and time-consuming remedial work to compensate for any length changes which occur can be dispensed with. Since it is possible to compensate for length changes caused by material compression in the brush member in the length compensation zone, when the inventive brush is rotated, steady true running, and consequently maximum smoothness and minimum bearing loading, are ensured.

Pursuant to further features of the present invention, the length compensating zone may be a recess, preferably an annular groove. The length compensating zone may be located adjacent to the contact surface, and in particular, may be connected directly to the contact surface.

The contact surface may be disposed between two length compensating zones, preferably of the same shape. Alternatively, the contact surface may be disposed adjacent to one spindle end.

If tufts of bristles of the bristle filling are secured in holes in the brush member, the length compensating zone, in the radial direction of the brush member, may be of a depth at least approximately equal to the depth of the holes.

DESCRIPTION OF PREFERRED EMBODIMENTS

Figure 1:
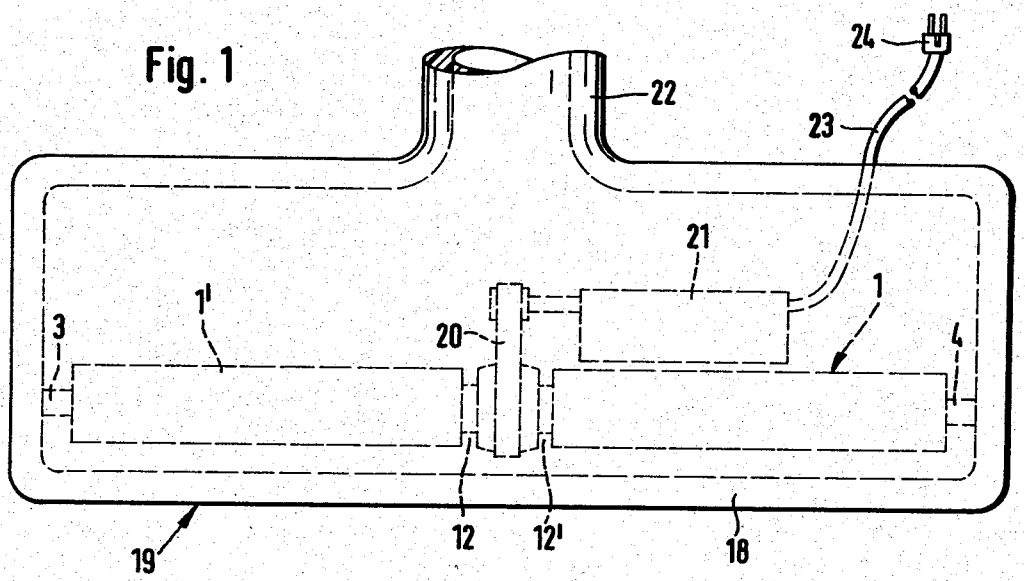
FIG. 1 shows a suction nozzle for a vacuum cleaner, in the nozzle housing of which one embodiment of the inventive brush is mounted.
Figure 2:
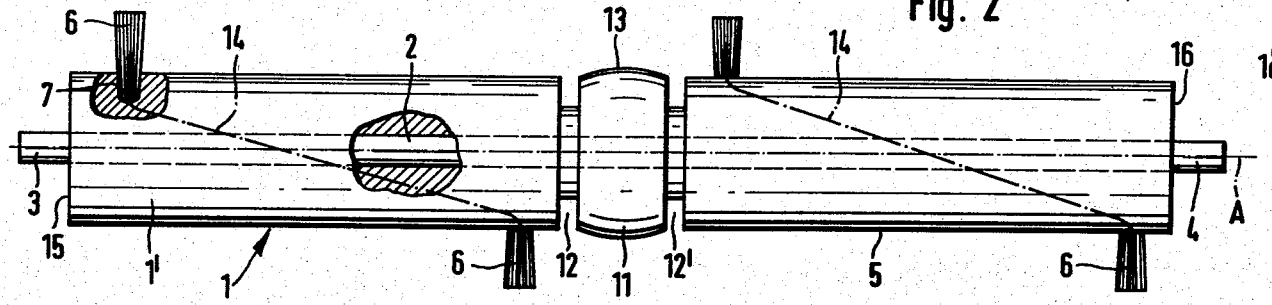
FIG. 2 is an enlarged elevational view of the brush of FIG. 1.

Referring now to the drawing in detail, the brush 1 of FIGS. 1 and 2 comprises a cylindrical brush member 1' which has a central longitudinal hole in which a bearing or support spindle 2 is inserted. The spindle ends 3 and 4 of this bearing spindle extend by an approximately equal distance beyond the brush member 1', and act as journal pins by means of which the brush member is mounted in a nozzle housing 18 of a cleaning apparatus 19 which is in the form of a suction nozzle for a dust suction extraction machine or vacuum cleaner. The suction nozzle can be connected to a suction duct or vacuum hose of a vacuum cleaner by means of a connection adapter 22.

Approximately midway in the brush member 1', the latter has a contact surface 11 in the form of a pulley, the axial extent of which is adequate for the width of a drive belt 20 placed on the contact surface 11. The outer face 13 of the contact surface 11 is radially outwardly curved, slightly convexly located centrally relative to the brush member 1'; the function thereof is to center the drive belt 20, which transmits the rotary motion of the drive motor 21 of the cleaning apparatus 19 to the brush 1. From the drive motor 21 there extends an electric cable 23 which has a plug 24 that can be plugged into a socket of the housing of a vacuum cleaner to make connection with the latter.

On both sides of the contact surface 11, the brush member 1' has holes 7 which extend approximately radially, and which open on the outer surface 5 of the brush member 1'. In these holes there are disposed the ends 8 of tufts of bristles 6 of a bristle filling 14; the tufts 6 extend radially in relation to the brush member 1'. The tufts of bristles 6 extend between the end faces 15 and 16 of the brush member 1' and the contact surface 11 parallel to or helically relative to the axis of rotation A of the brush member 1'. The tufts of bristles 6 are folded approximately in hairpin fashion; at their folded ends 8, a needle-like wire retainer 9 is passed through such folded ends 8. With this wire retainer, the tuft folded ends 8 are pushed at high pressure into the side walls 10 of the holes 7 in order to anchor the tufts of bristles 6. This creates compression and internal stresses in the brush member 1' in the region of the retainer 9, and resulting in extending the length of the brush member 1' and causing it to buckle, which is translated into unsteady running and lack of trueness when the brush 1 rotates.

To compensate for these internal stresses created by this anchoring, there is provided adjacent to the contact surface section 11, at each side, a recessed annular groove 12, 12' which acts as a length compensation zone, and which is formed by incisions. These recesses are of approximately the same depth as the holes 7. With these recesses it is possible for the stresses and length changes created by anchoring with the retainers 9 in the holes 7 to be compensated for, so that there is no buckling, and the true running of the brush member 1' is not adversely affected. The recessed annular grooves 12, 12' are immediately adjacent to the contact surface section 11, as a result of which the effective bristle filling 14 is not reduced at the two sides of the contact surface section.

Figure 3:
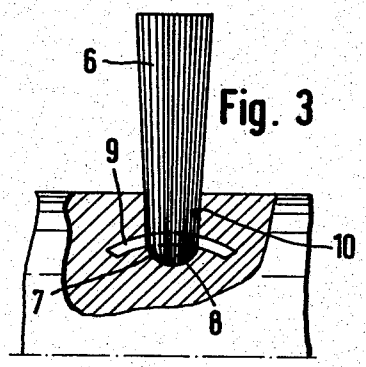
FIG. 3 is an enlarged view of a portion of a brush member of the brush of FIG. 2 with a tuft of bristles of a bristle filling.
Figure 4:
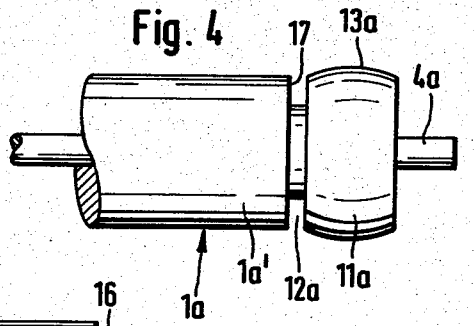
FIG. 4 is an elevational view of one end of a brush member of a second embodiment of the inventive brush.

In the exemplary embodiment illustrated in FIG. 4, the contact surface section 11*a*, with its outer face 13*a*, is located at one end 17 of the brush member 1*a*'. Only one recessed annular groove 12*a* is provided as a length compensation zone, and is disposed on that side of the contact surface section 11*a* remote from the spindle end 4*a*, and immediately adjacent to it. Also, with this recess 12*a*, it is possible to compensate perfectly for length changes brought about by anchoring the bristle filling in the brush member 1*a*', so that this brush 1*a* runs smoothly and truly in operation, which could not cause any bearing overloading.

The present invention is, of course, in no way restricted to the specific disclosure of the specification and drawing, but also encompasses any modifications within the scope of the appended claims.

What we claim is:

1. A motor driven cylindrical brush for a cleaning apparatus which includes a brush housing; said brush comprising:

a cylindrical brush member mounted in said brush housing, said brush member being provided with a centrally outwardly curved contact surface for a drive belt which is operatively associated with a motor;

length compensation means provided with said brush member and including at least one length compensating zone therewith, which extends at right angles to the longitudinal axis of said brush member;

a bristle filling inserted in said brush member and projecting radially beyond said brush member; and a bearing spindle connected to said brush member and having opposite ends which project axially beyond said brush member for effecting mounting thereof in said brush housing, said length compensation means avoiding any unsteady running of said brush member as well as subsequent dynamic balancing of said brush member otherwise needed to compensate for any buckling occurring as a consequence of material compression when said bristle filling is inserted in said brush member, and caused by length changes due thereto said at least one length compensating zone being at least one annular recess in said brush member; each of said recesses being connected directly to said contact surface; said bristle filling comprising tufts of bristles, and said brush member including holes for receiving said tufts of bristles; each of said recesses, in the radial direction of said brush member, having a depth which is at least approximately equal to the depth of said holes.

2. A brush according to claim 1, in which each of said recesses is an annular groove.

3. A brush according to claim 1, in which each of said recesses is disposed adjacent to said contact surface.

4. A brush according to claim 1, which includes two recesses, with said contact surface being disposed therebetween.

5. A brush according to claim 4, in which each of said recesses has the same shape.

6. A brush according to claim 3, in which said contact surface is disposed adjacent to one of said opposed ends of said bearing spindle.

* * * * *